US012253014B1

(12) United States Patent
Laigle et al.

(10) Patent No.: US 12,253,014 B1
(45) Date of Patent: Mar. 18, 2025

(54) REDUCED INTERNAL COMBUSTION ENGINE PARTICULATE MATTER EMISSIONS

(71) Applicant: SAUDI ARABIAN OIL COMPANY, Dhahran (SA)

(72) Inventors: Emmanuel Laigle, Courbevoie (FR); Christophe Chaillou, Rueil-Malmaison (FR); Caroline Norsic, Rueil-Malmaison (FR)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/489,944

(22) Filed: Oct. 19, 2023

(51) Int. Cl.
*F01N 3/032* (2006.01)
*F01N 3/031* (2006.01)
(Continued)

(52) U.S. Cl.
CPC ..... *F01N 3/035* (2013.01); *F01N 3/031* (2013.01); *F01N 3/103* (2013.01);
(Continued)

(58) Field of Classification Search
CPC ..... F01N 3/035; F01N 3/031; F01N 3/103; F01N 13/0093; F01N 13/011; F01N 2250/02; F01N 2560/06; F01N 2560/08
See application file for complete search history.

(56) References Cited

U.S. PATENT DOCUMENTS 4,702,075 A 10/1987 Jenny
7,735,314 B2 6/2010 Lu et al.
(Continued)

FOREIGN PATENT DOCUMENTS

CA 2396281 A1 12/2001
CH 665002 A5 4/1988
(Continued)

OTHER PUBLICATIONS

Office Action issued in corresponding Domestic U.S. Appl. No. 17/144,535; dated Jul. 23, 2021 (18 pages).
(Continued)

*Primary Examiner* — Matthew T Largi
(74) *Attorney, Agent, or Firm* — Osha Bergman Watanabe & Burton LLP

(57) ABSTRACT

A system for reducing internal combustion engine emissions includes a main exhaust line, a multi-particulate filter, and a valve connected between the main exhaust line and the multi-particulate filter. The multi-particulate filter contains a first particulate filter, a second particulate filter, a first ozone injector, a second ozone injector, and an oxidation catalyst. A process for reducing internal combustion engine emissions includes flowing exhaust emissions through a main exhaust line and alternating filtering the exhaust emissions with a first and second particulate filter. Alternating includes adjusting one or more valves to bypass the second particulate filter and filter the exhaust emissions with the first particulate filter while injecting the second particulate filter with ozone. The process also includes adjusting the position of the one or more valves to flow exhaust emissions to the second particulate filter while the first particulate filter receives injected ozone.

11 Claims, 7 Drawing Sheets

(51) Int. Cl.

| | |
|---|---|
| ***F01N 3/035*** | (2006.01) |
| ***F01N 3/10*** | (2006.01) |
| ***F01N 13/00*** | (2010.01) |

(52) U.S. Cl.
CPC ..... *F01N 13/0093* (2014.06); *F01N 13/011* (2014.06); *F01N 2250/02* (2013.01); *F01N 2560/06* (2013.01); *F01N 2560/08* (2013.01)

(56) References Cited

U.S. PATENT DOCUMENTS

| | | | | |
|---|---|---|---|---|
| 7,954,313 | B2 * | 6/2011 | Hirata | F01N 3/031 60/287 |
| 8,161,732 | B2 | 4/2012 | Peters et al. | |
| 9,021,792 | B2 * | 5/2015 | Hosoya | F01N 3/106 60/299 |
| 9,482,125 | B2 | 11/2016 | Gonze et al. | |
| 9,719,386 | B2 * | 8/2017 | Fan | F01N 13/017 |
| 10,072,551 | B2 | 9/2018 | Uchiyama et al. | |
| 10,590,827 | B2 | 3/2020 | Ulrey et al. | |
| 11,661,872 | B2 | 5/2023 | Laigle et al. | |
| 2002/0175212 | A1 * | 11/2002 | Hepburn | F01N 3/0814 236/DIG. 8 |
| 2005/0241295 | A1 * | 11/2005 | Breuer | B01D 53/944 60/311 |
| 2006/0153761 | A1 * | 7/2006 | Bandl-Konrad | F01N 13/009 423/239.1 |
| 2008/0271439 | A1 | 11/2008 | Londos | |
| 2009/0235648 | A1 * | 9/2009 | Kakinohana | F02D 41/123 60/299 |
| 2009/0308060 | A1 * | 12/2009 | Suzuki | F01N 3/0233 60/311 |
| 2010/0281856 | A1 * | 11/2010 | Sakakibara | F01N 3/035 60/297 |
| 2010/0287911 | A1 * | 11/2010 | Katsuki | F02D 41/1447 60/287 |
| 2014/0366515 | A1 | 12/2014 | Kowalkowski et al. | |
| 2017/0102311 | A1 | 4/2017 | Zhang | |
| 2018/0334982 | A1 | 11/2018 | Sanborn et al. | |
| 2018/0353905 | A1 | 12/2018 | Li et al. | |
| 2019/0017423 | A1 | 1/2019 | Martin et al. | |
| 2019/0383189 | A1 * | 12/2019 | Dou | F01N 3/035 |
| 2022/0220875 | A1 | 7/2022 | Laigle et al. | |
| 2022/0290599 | A1 | 9/2022 | Dou et al. | |

FOREIGN PATENT DOCUMENTS

| | | | |
|---|---|---|---|
| CN | 108223060 | A | 6/2018 |
| DE | 10241063 | A1 | 3/2004 |
| DE | 102017102098 | A1 | 8/2017 |
| EP | 1947303 | A1 | 7/2008 |
| FR | 2859240 | A1 | 3/2005 |
| JP | 2004084494 | A | 3/2004 |
| JP | 3600582 | B2 | 12/2004 |
| JP | 2005330936 | A | 12/2005 |
| JP | 2005538295 | A | 12/2005 |
| JP | 2007132240 | A | 5/2007 |
| JP | 2008002308 | A | 1/2008 |
| JP | 2008175136 | A | 7/2008 |
| JP | 4344565 | B2 | 10/2009 |
| JP | 4449947 | B2 | 4/2010 |
| JP | 201121456 | A | 2/2011 |
| KR | 100864600 | B1 | 10/2008 |
| WO | 2006117993 | A2 | 11/2006 |
| WO | 2006125928 | A1 | 11/2006 |
| WO | 2006135073 | A1 | 12/2006 |
| WO | 2008053105 | A1 | 5/2008 |

OTHER PUBLICATIONS

Yusuf, A.A. et al., "Effect of cold start emissions from gasoline-fueled engines of light duty vehicles at low and high ambient temperatures: Recent trends," Case Studies in Thermal Engineering, 14, 100417, pp. 1-10, Feb. 20, 2019 (10 pages).

Final Office Action issued in corresponding U.S. Appl. No. 18/324,764, dated Mar. 26, 2024 (24 pages).

International Search Report issued for corresponding international patent application No. PCT/US2024/030401, mailed Sep. 3, 2024 (6 pages).

Written Opinion issued for corresponding international patent application No. PCT/US2024/030401, mailed Sep. 3, 2024 (9 pages).

* cited by examiner

REDUCED INTERNAL COMBUSTION ENGINE PARTICULATE MATTER EMISSIONS

BACKGROUND

Internal combustion engines emit gaseous pollutants such as carbon monoxide (CO), carbon dioxide ($CO_2$), unburned hydrocarbons, nitrogen oxide ($NO_x$) as well as solid pollutants such as particulate matter. As legislation has tightened the rules for vehicle emissions, new exhaust purification systems have been developed to reduce emissions. Most of the exhaust lines for internal combustion engines include one or more catalysts to reduce gaseous pollutants. Environmental concerns and government regulations have led to efforts focused on improving the removal of combustion by-products and exhaust pollutants from vehicle engine exhaust gases. Common exhaust lines are typically equipped with one or more components, such as a particulate filter, sensors, or a catalytic converter, in order to reduce pollutants from the high concentrations observed directly from the engine to low concentrations at the tailpipe.

FIG. 1 shows an example of a conventional engine system 16, which includes an internal combustion engine 18 such as a compression-ignition diesel engine coupled to an exhaust particulate filter system 20. Exhaust particulate filter system 20 includes an exhaust particulate filter 22 fluidly connected with engine 18 to trap particulates such as soot and ash in engine exhaust. Filter 22 may include a canister or housing 24 having an exhaust inlet 25 fluidly connected with an exhaust conduit 28 coupled with engine 18 in a conventional manner, and an exhaust outlet 27 coupled with an outlet conduit 32, in turn connecting with an exhaust stack or tailpipe (not shown) in a conventional manner. In some systems, a regeneration mechanism 34 (e.g., an ozone injector) is positioned fluidly between engine 18 and filter 22 to enable regeneration of filter 22. A diesel oxidation catalyst (not shown) may also be located fluidly between engine 18 and filter 22. A filter medium 26 is positioned within housing 24 and configured for trapping particulates such as soot and ash in exhaust from engine 18. The filter system 20 may further include a control system 40 for filter 22.

In conventional exhaust lines having a particulate filter, the particulate filter will need to be cleaned on a regular basis to remove trapped particulates and maintain exhaust flow therethrough. Particulate filters are typically cleaned through a process referred to as regeneration. During filter regeneration, soot trapped in the filter is combusted and burnt off to prevent soot accumulation and make sure the passages through the filter remain open. The trapped soot may be burnt off by heating the filter to a temperature sufficient to combust the soot, which may be accomplished through passive regeneration (where additional efforts to increase the exhaust temperature is not needed, e.g., where sufficient heat is generated from high engine usage such as by driving at high speeds and/or for a minimum duration) or through active regeneration (where additional efforts are used to increase the exhaust temperature, e.g., using post combustion fuel injection into the combustion chamber to increase the temperature of the exhaust). Thus, particulate filters are typically positioned as close to the engine as possible to provide the heat needed for regeneration.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for reducing internal combustion engine emissions including a main exhaust line fluidly connected to an internal combustion engine. A multi-particulate filter assembly is connected between the main exhaust line and the tailpipe. The multi-particulate filter assembly may include a first particulate filter along a first filter line and a second particulate filter along a second filter line. First and second ozone injectors may be positioned upstream of the first and second particulate filters. A valve may be located between the main exhaust line and the multi-particulate filter assembly, such that when the valve is in a first position, the exhaust line is in fluid communication with the first filter line, and when the valve is in a second position, the flow between the main exhaust line and the first filter line is bypassed. Systems disclosed herein may also include an oxidation catalyst, e.g., provided as a coating in the particulate filter(s) or provided in oxidation catalyst units downstream of the particulate filter(s).

In another aspect, embodiments disclosed herein relate to processes for reducing internal combustion engine emissions by flowing exhaust emissions through a main exhaust line from an internal combustion engine and alternating filtering the exhaust emissions with a first particulate filter and a second particulate filter in a multi-particulate filter assembly. When alternating the exhaust emissions flow pathways, one or more valves may be adjusted in a first mode to flow the exhaust emissions to the first particulate filter, bypassing the second particulate filter. In the first mode, exhaust emissions may be filtered with the first particulate filter, collecting soot on the first particulate filter. During the first mode, the second particulate filter may receive an injected ozone stream to combust an amount of soot on the second particulate filter, producing carbon monoxide. During a second mode, the one or more valves may be adjusted to flow the exhaust emissions to the second particulate filter, bypassing the first particulate filter. During the second mode, the first particulate filter may receive injected ozone to combust soot on the first particulate filter, producing carbon monoxide.

Other aspects and advantages of the claimed subject matter will be apparent from the following description and the appended claims.

BRIEF DESCRIPTION OF DRAWINGS

Wherever possible, like or identical reference numerals are used in the figures to identify common or the same elements. The figures are not necessarily to scale and certain features and certain views of the figures may be shown exaggerated in scale for purposes of clarification.

DETAILED DESCRIPTION

Figure 1:
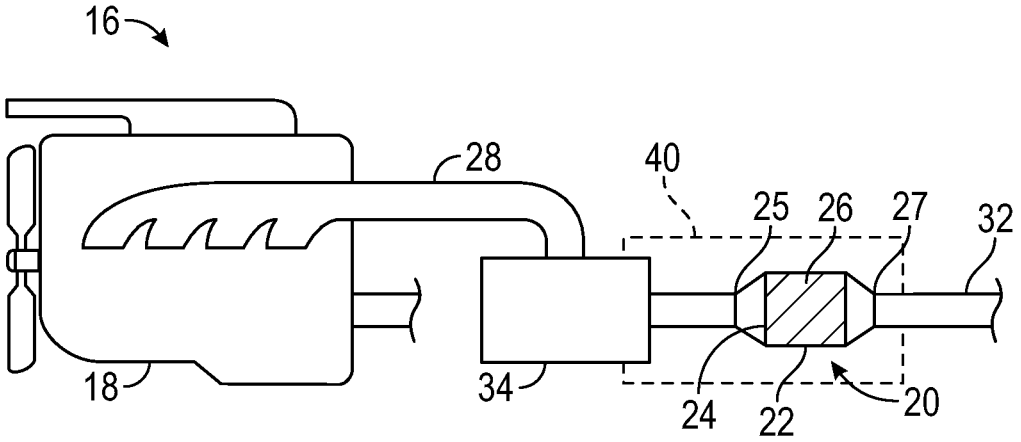
FIG. 1 (Prior Art)
FIG. 1 is a process flow diagram of a conventional engine system in accordance with one or more embodiments.

As used herein, the terminology "example," "embodiment," "element," or the like indicates serving as an example, instance, or illustration. Unless expressly indicated, any example, embodiment, aspect, feature, or element is independent of each other example, embodiment, aspect, feature, or element and may be used in combination with any other example, embodiment, aspect, feature, or element. Thus, features from any of the embodiments described herein may be used in combination with one another in accordance with the general principles described herein. These and other embodiments, features, and advantages will be more fully understood upon reading the following detailed description.

In one aspect, embodiments disclosed herein relate to a system for reducing internal combustion engine emissions including an assembly of multiple particulate filters and an oxidation catalyst. In another aspect, embodiments disclosed herein relate to a process for reducing internal combustion engine emissions including alternating operating different particulate filters in a multi-particulate filter assembly while regenerating a non-operating filter in the multi-particulate filter assembly.

Particulate filters may be used to collect particulate matter in engine emissions before entering into the environment. Particulate filters generally include structures having one or more filters (e.g., meshes, porous material, fibrous material, etc.) positioned through a flow path to catch particulates as they are flowed therethrough. For example, common particulate filters may have honeycomb structures of filter material with channel blocks at alternate ends. Engine emissions flow through the walls of the particulate filter between the channels, retaining particulate matter. Particulate filters may cause a large pressure drop in the exhaust line, reducing the power of the engine and increasing fuel consumption. Selection of particulate filter may be based on filtration efficiency and back pressure (as it relates to volumetric flow). Examples of relevant materials for particulate filters include cordierite and silicon carbide.

In one or more embodiments, soot may be removed from a particulate filter in a regeneration process by burning it off in-situ in the presence of ozone and at temperatures between 10° and 300° C., when a particulate filter is not in use for filtration operations. To initiate regeneration, the particulate filter may be injected with ozone for short periods. This ozone, combined with high exhaust temperatures (e.g., between 10° and 300° C.), leads to soot ignition. Regeneration processes are used to remove accumulated particulate matter from the filter that may block flow of the exhaust.

In one or more embodiments, methods of reducing engine emissions using particulate filters include flowing exhaust emissions through an exhaust line from an internal combustion engine through a multi-particulate filter assembly. Multi-particulate filter assemblies according to embodiments of the present disclosure may include two or more particulate filters assembled together with associated ozone injectors and oxidation catalyst via valve(s) and piping. Examples of multi-particulate filter assemblies according to embodiments of the present disclosure are described herein with reference to a double particulate filter assembly having two particulate filters for ease of description and understanding. However, the designs and operations described with reference to double particulate filters may likewise be applied to multi-particulate filter assemblies having more than two particulate filters (e.g., three particulate filters, four particulate filters, five particulate filters, or more, as room allows in the exhaust system).

A double particulate filter assembly according to embodiments of the present disclosure may include a first particulate filter and a second particulate filter, associated ozone injector(s), and an oxidation catalyst. During methods according to embodiments of the present disclosure, exhaust emissions may be alternatingly flowed through the first particulate filter and the second particulate filter in the double particulate filter assembly. In such manner, an operating particulate filter (the first or second particulate filter) may be filtering the exhaust emission flow while a non-operating particulate filter (the other of the first or second particulate filter) may undergo a regeneration process.

For example, in a system containing a double particulate filter assembly, a first particulate filter may be in operation, filtering out particulate matter from the engine exhaust emissions, while a second particulate filter is in a regeneration process. A separate ozone injector may be located upstream of each of the particulate filters. Ozone may be produced in an ozone generator and supplied to both of the ozone injectors. An ozone generator produces ozone from oxygen. During regeneration of the second particulate filter in the double particulate filter assembly, the ozone injector associated with the regenerating second particulate filter may inject ozone upstream of the second particulate filter for use in the regeneration process. The regeneration process generates additional carbon monoxide in the engine emissions, which will be fed to an oxidation catalyst in the double particulate filter assembly to reduce the presence of this harmful compound into the environment. Upon completion of regeneration of the second particulate filter, the process may include alternating operational status of the particulate filters, where the second regenerated particulate filter may be operated to filter out the engine exhaust emissions while the first particulate filter is regenerated.

As mentioned above, other multi-particulate filter assemblies having more than two particulate filters may be assembled and used applying the same concepts and principles described herein with respect to the examples of double particulate filter assemblies. For example, in multi-particulate filter assemblies having more than two particulate filters, exhaust emissions may be alternatingly flowed through different particulate filters (e.g., using one or more valves), where one or more operating particulate filters may be filtering exhaust while the remaining particulate filter(s) (non-operating) may undergo a regeneration process. Ozone may also be supplied to regenerating particulate filter(s) in multi-particulate filter assemblies having more than two particulate filters using the same principles described herein with respect to the examples of double particulate filter assemblies.

Alternating operation processes disclosed herein may be achieved through adjusting one or more valves based on the configuration of the particulate filters in the multi-particulate filter assembly, e.g., based on where first and the second particulate filters are located relative to each other in a double particulate filter assembly. For example, according to embodiments of the present disclosure, a valve may be located between the exhaust line and the double particulate filter assembly, where in a first position, the valve allows exhaust emissions to flow through a first filter line with the first particulate filter, and in a second position, the valve allows exhaust emissions to bypass the first filter line (thus bypassing the first particulate filter). In some embodiments, the valve positioned between the exhaust line and the double particulate filter assembly used to direct flow through or bypass the first filter line may also be used to direct flow through or bypass a second filter line with the second particulate filter. In such embodiments, a double particulate filter assembly may have a single valve, where in the first position, the valve allows exhaust emissions to flow through the first filter line (and first particulate filter), and in the second position, the valve allows exhaust emissions to flow through the second filter line (and second particulate filter). In some embodiments, a double particulate filter assembly may have multiple valves, where a first valve located between the exhaust line and the double particulate filter assembly may be used to direct flow through or bypass the first filter line, and a second valve within the double particulate filter assembly may be used to direct flow through or bypass the second filter line. According to embodiments of the present disclosure, valve(s) in a double particulate filter assembly may be used to control the flow of exhaust emissions through a selected path in the double particulate filter assembly to the tailpipe.

Using various valve configurations, an alternating of particulate filter operation and regeneration allows for continuous, effective particulate filtration and oxidation catalysis of engine exhaust emissions. For example, one or more valves may first be adjusted to a first mode allowing the exhaust emissions to flow through a first particulate filter of a double particulate filter assembly, during which, soot be collected on the first particulate filter. During the first mode, the positions of the valve(s) may block flow to a second particulate filter in the double particulate filter assembly. While flow to the second particulate filter is blocked, the second particulate filter may receive an injected ozone stream to combust an amount of soot on the second particulate filter in a regeneration process, producing carbon monoxide to be reacted with an oxidation catalyst. After a period for regeneration, the valve(s) may be adjusted to a second mode to prevent flow to the first particulate filter and allow the exhaust emissions to flow to the second particulate filter. During the second mode, the first particulate filter may receive an injected ozone stream to combust an amount of soot on the first particulate filter in a regeneration process, producing carbon monoxide to be reacted with an oxidation catalyst. In some embodiments, multiple particulate filters (some or all of the particulate filters in a multi-particulate filter assembly) may be operated simultaneously. In some embodiments, multiple particulate filters (some or all of the particulate filters in a multi-particulate filter assembly) may be regenerated simultaneously.

According to embodiments of the present disclosure, an oxidation catalyst provided with a multi-particulate filter assembly may convert carbon monoxide and hydrocarbons in the exhaust emissions into carbon dioxide and water. In some embodiments, the oxidation catalyst may be in the form of a coating on the internal porous structure within each of the particulate filters in a multi-particulate filter assembly. For example, an oxidation catalyst coating may include one or more platinum group metals (PGM) mixed inside a washcoat (e.g., made of alumina (Al2O3) with mixed oxides (e.g., CeO2, ZrO2, La2O3, TiO2 . . . )), where the washcoat is impregnated on a particulate filter substrate (e.g., made of cordierite and/or silicon carbide). Platinum and/or palladium may be selected as PGM oxidation catalyst coating material for conversion of pollutants, such as rhodium. In one or more embodiments, an oxidation catalyst coating used in a multi-particulate filter assembly may have a loading of about 25 $g/ft^3$ or less. For example, with a particulate filter having 1 L (about 0.036 $ft^3$) catalyst with a 25 $g/ft^3$ loading, the catalyst may contain approximately 0.9 g of platinum-group metals (e.g., platinum and/or palladium). In one or more embodiments, an oxidation catalyst coating may include platinum, palladium, or both.

In other embodiments, particulate filters in a multi-particulate filter assembly may not contain a catalyst coating, and instead, a separate catalyst unit may be situated downstream of the particulate filters. In these embodiments, there may be a catalyst unit shared between some or all of the particulate filters in a multi-particulate filter assembly, or there may be a separate catalyst unit for each of the particulate filters in a multi-particulate filter assembly.

In some embodiments, sensors may be present to monitor system parameters. For example, in some embodiments, temperature sensors and/or pressure sensors may be present at the inlet of each particulate filter. In some embodiments, pressure sensors may also be present at the outlet of each of the particulate filters. In other embodiments, pressure sensors may be present at the inlet and outlet of the overall multi-particulate filter assembly. In some embodiments, temperature sensors may be present at the inlet and outlet of the overall multi-particulate filter assembly. In some embodiments, the sensors may communicate data to an Electronic Control Unit (ECU) configured to develop a soot combustion model.

Figure 2:
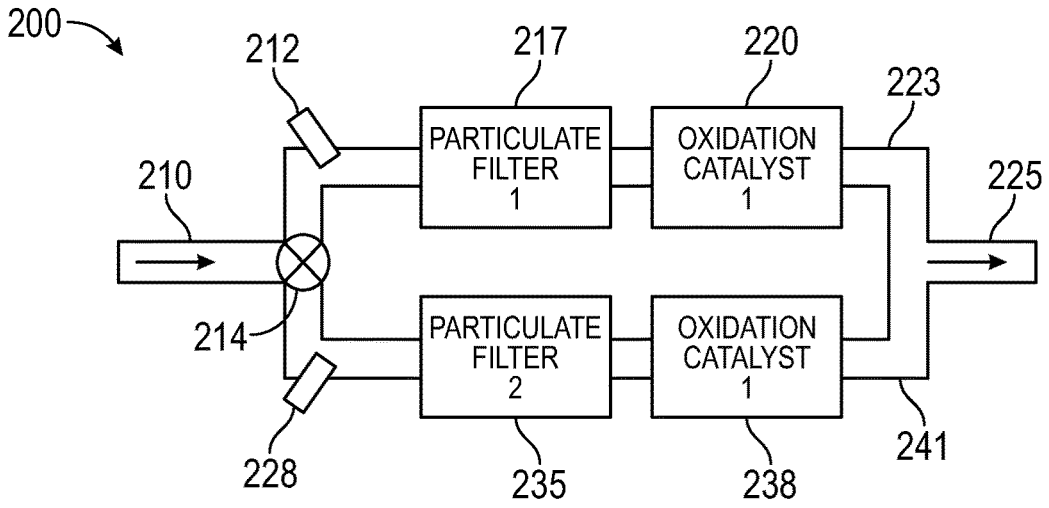
FIG. 2 is a process flow diagram of a double particulate filter assembly including two parallel particulate filters and two parallel catalyst units in accordance with one or more embodiments.
Figure 3:
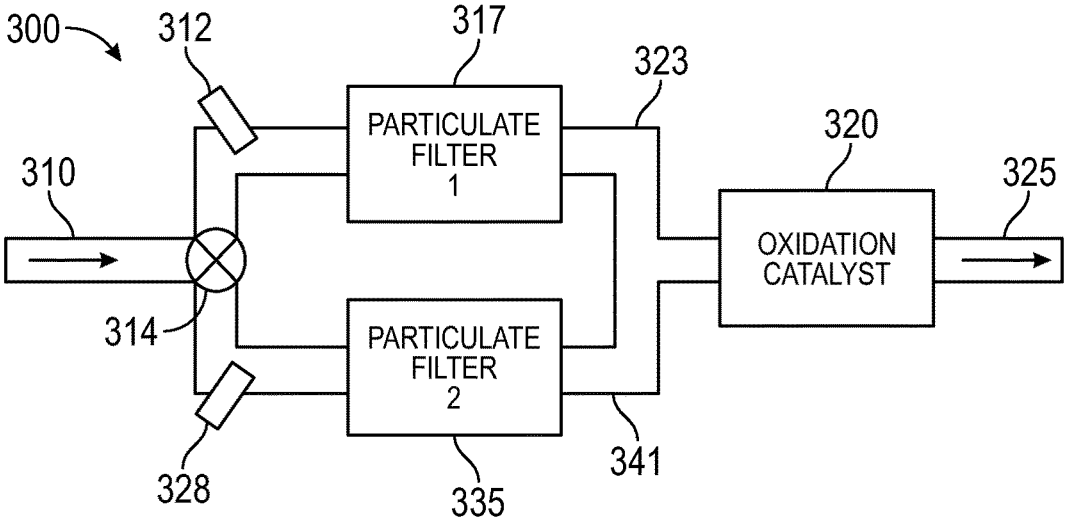
FIG. 3 is a process flow diagram of a double particulate filter assembly including two parallel particulate filters and a catalyst unit in accordance with one or more embodiments.
Figure 4:
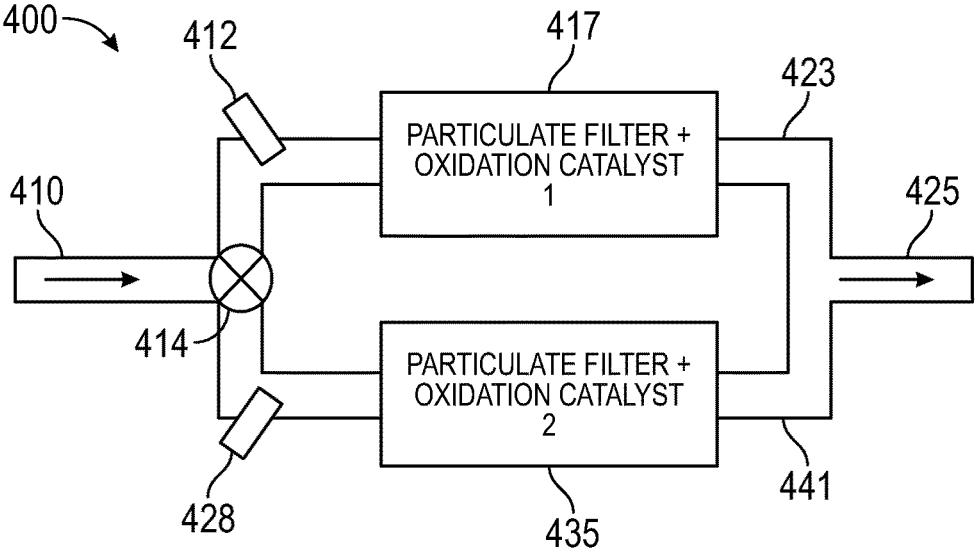
FIG. 4 is a process flow diagram of a double particulate filter assembly including two parallel particulate filters with an oxidation catalyst coating in accordance with one or more embodiments.
Figure 5:
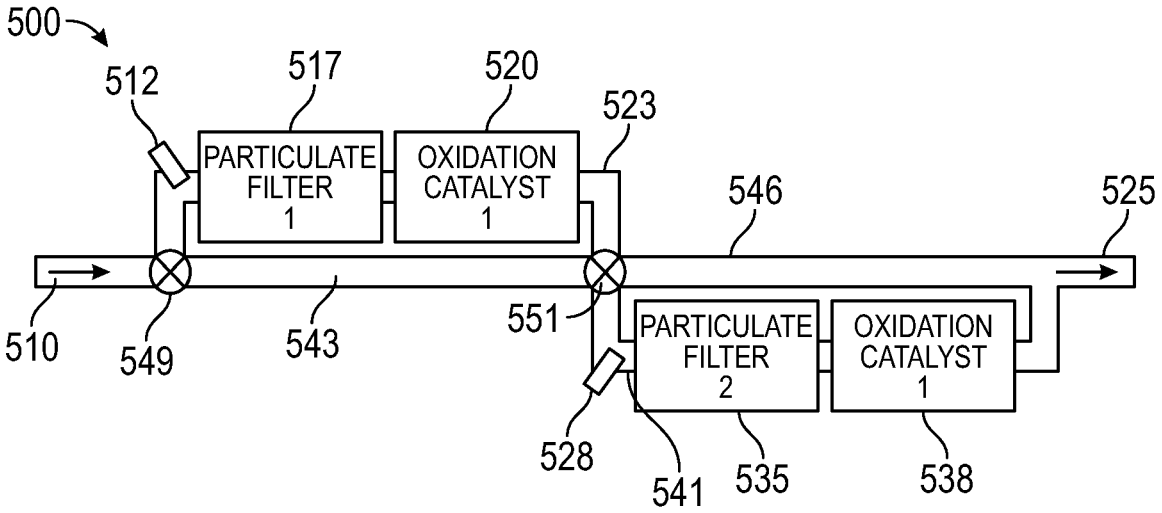
FIG. 5 is a process flow diagram of a double particulate filter assembly including two particulate filters and two catalyst units in accordance with one or more embodiments.
Figure 6:
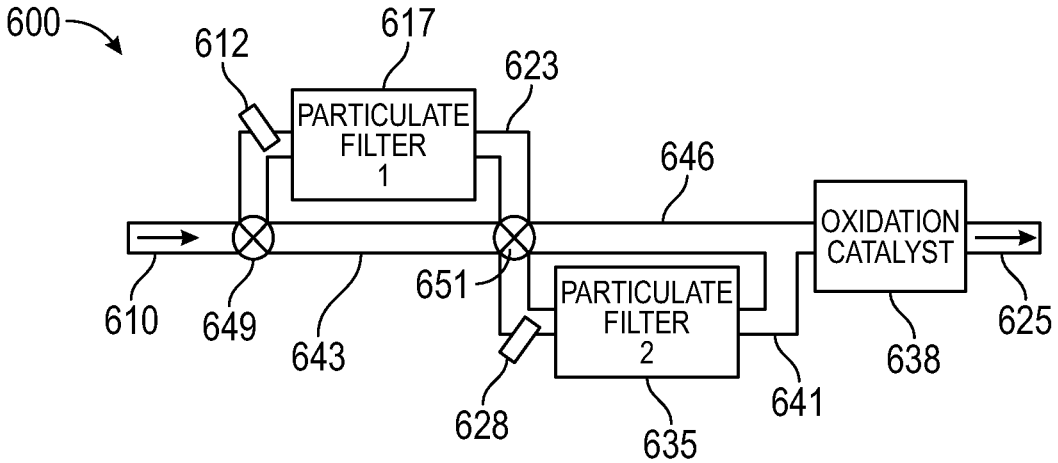
FIG. 6 is a process flow diagram of a double particulate filter assembly including two particulate filters in series with a catalyst unit in accordance with one or more embodiments.
Figure 7:
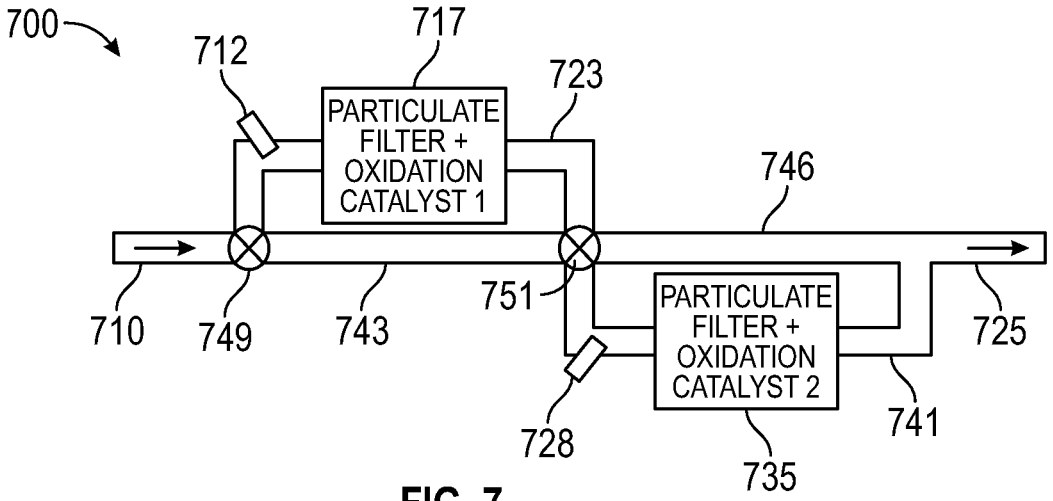
FIG. 7 is a process flow diagram of a double particulate filter assembly including two particulate filters each with an oxidation catalyst coating in series in accordance with one or more embodiments.

Referring now to FIGS. 2-7, different example configurations of double particulate filter assemblies are shown. For example, as shown in FIGS. 2-4, a double particulate filter assembly may have multiple particulate filters assembled in parallel to allow for alternating operation between the particulate filters. In some embodiments, a double particulate filter assembly may have multiple particulate filters assembled in series with bypass lines to allow for alternating operation between the particulate filters, as shown in FIGS. 5-7.

While double particulate filter assemblies are shown in the examples in FIGS. 2-7, more than two particulate filters may be assembled in like-manner as shown in FIGS. 2-7. For example, three or more particulate filters may be assembled in parallel in like-manner as shown in FIGS. 2-4, and three or more particulate filters may be assembled in series in like-manner as shown in FIGS. 5-7. Additionally, as can be appreciated by those skilled in the art, one or more features shown in FIGS. 2-7 may be used in combination with other embodiments shown in FIGS. 2-7. For example, a multi-particulate filter assembly may include two or more particulate filters assembled in parallel and two or more particulate filters assembled in series. Other combinations of features shown in FIGS. 2-7 may be envisioned upon reading this disclosure.

In FIG. 2, a double particulate filter assembly 200 includes a three-way valve 214, first and second filter lines 223, 241, first and second particulate filters 217, 235, first and second oxidation catalyst units 220, 238, and first and second ozone injectors 212, 228. The first particulate filter 217 is in series with the first oxidation catalyst unit 220 along the first filter line 223. The first ozone injector 212 is upstream of the first particulate filter 217 in the first filter line 223. The second particulate filter 235 is in series with the second oxidation catalyst 238 along the second filter line 241. The second ozone injector 228 is upstream of the second particulate filter 235 in the second filter line 241. The first filter line 223 and the second filter line 241 are in a parallel configuration to ensure that the particulate filters and the oxidation catalysts are in parallel. The three-way valve 214 controls the flow between the two filter lines. The double particulate filter assembly 200 is in fluid communication with a main exhaust line 210 of an engine and a tailpipe 225 providing the outlet to the engine's exhaust system. The main exhaust line 210 fluidly feeds exhaust into the double particulate filter assembly 200, and the two parallel streams converge together at the tailpipe 225 to carry the treated exhaust emissions to the environment.

In one or more embodiments, an inlet to a double particulate filter assembly may be directly connected to an end of the main exhaust line, and an outlet of the double particulate filter assembly may be directly connected to the tailpipe. For example, the inlet to the double particulate filter assembly 200 in FIG. 2 may be at the inlet to the valve 214, and the outlet to the double particulate filter assembly 200 may be a pipe connection piece downstream of where the first and second filter lines 223, 241 converge.

In FIG. 3, a double particulate filter assembly 300 includes a three-way valve 314, first and second filter lines 323, 341, first and second particulate filters 317, 335, first and second ozone injectors 312, 328, and a single oxidation catalyst unit 320. The first particulate filter 317 and the second particulate filter 335 are in a parallel configuration. A main exhaust line 310 directs exhaust emissions to the first filter line 323 containing the first particulate filter 317, and the second filter line 341, containing the second particulate filter 335, using the three-way valve 314. The first ozone injector 312 is upstream of the first particulate filter 317 in the first filter line 323. The second ozone injector 328 is upstream of the second particulate filter 335 in the second filter line 341. The first filter line 323 and the second filter line 341 converge together to a shared oxidation line having the single oxidation catalyst unit 320. In such configuration, exhaust emissions may be flowed from the first and second filter lines 323, 341 to the single oxidation catalyst unit 320 before flowing the treated exhaust emissions through a tailpipe 325.

In FIG. 4, a double particulate filter assembly 400 includes a three-way valve 414, first and second filter lines 423, 441, first and second ozone injectors 412, 428, and first and second particulate filters 417, 435, where each particulate filter 417, 435 includes an oxidation catalyst coating. The first particulate filter 417 with an oxidation catalyst coating and the second particulate filter 435 with an oxidation catalyst coating are in a parallel configuration. A main exhaust line 410 directs exhaust emissions to the first filter line 423, containing the first particulate filter 417 with an oxidation catalyst coating, and the second filter line 441, containing the second particulate filter 435 with an oxidation catalyst coating, using the three-way valve 414. The first ozone injector 412 is upstream of the first particulate filter 417, and the second ozone injector 428 is upstream of the second particulate filter 435. The first filter line 423 and the second filter line 441 converge together to flow treated exhaust emissions through a connected tailpipe 425.

In FIG. 5, a double particulate filter assembly 500 includes first and second valves 549, 551, first and second filter lines 523, 541, first and second ozone injectors 512, 528, first and second particulate filters 517, 535, first and second oxidation catalyst units 520, 538, and first and second bypass lines 543, 546. The double particulate filter assembly 500 is connected at an inlet to a main exhaust line 510 of an engine and connected at an outlet to a tailpipe 525 of the engine's exhaust system. The main exhaust line 510 may flow exhaust emissions through either the first filter line 523 or the first bypass line 543, using the first valve 549. The first filter line 523 has the first particulate filter 517, the associated first ozone injector 512, and the associated first oxidation catalyst unit 520 arranged in series along the first filter line 523. The first filter line 523 and the first bypass line 543 converge at the second valve 551, which may direct exhaust emissions through the second filter line 541 or the second bypass line 546. The second filter line 541 includes the second particulate filter 535, the associated second ozone injector 528, and the associated second oxidation catalyst unit 538 arranged in series along the second filter line 541. The second filter line 541 and the second bypass line 546 converge together to flow the treated exhaust emissions through the connected tailpipe 525.

In FIG. 6, a double particulate filter assembly 600 connected between a main exhaust line 610 and a tailpipe 625 includes first and second valves 649, 651, first and second filter lines 623, 641, first and second ozone injectors 612, 628, first and second particulate filters 617, 635, a shared oxidation catalyst unit 638, and first and second bypass lines 643, 646. The first bypass line 643 is in parallel with the first filter line 623, the second bypass line 646 is in parallel with the second filter line 641, where the first line assembly is in series with the second line assembly. The main exhaust line 610 may flow exhaust emissions through either the first filter line 623 or the first bypass line 643, using the first valve 649. The first filter line 623 contains the first ozone injector 612 and the first particulate filter 617. The first filter line 623 and the first bypass line 643 converge at the second valve 651, which may be controlled to direct the exhaust emissions through the second filter line 641 or the second bypass line 646. The second filter line 641 includes the second ozone injector 628 and the second particulate filter 635. The second filter line 641 and the second bypass line 646 converge together to flow the treated exhaust emissions through the tailpipe 625.

In FIG. 7, a double particulate filter assembly 700 connected between a main exhaust line 710 and a tailpipe 725 includes first and second valves 749, 751, first and second filter lines 723, 741, first and second ozone injectors 712, 728, first and second particulate filters 717, 735, each particulate filter 717, 735 having an oxidation catalyst coating, and first and second bypass lines 743, 746. The main exhaust line 710 may flow exhaust emissions through either the first filter line 723 or the first bypass line 743, using the first valve 749. The first filter line 723 contains the first ozone injector 612 and the first particulate filter with an oxidation catalyst coating 717. The first filter line 723 and the first bypass line 743 converge at the second valve 751, which may be controlled to direct the exhaust emissions through the second filter line 741 or the second bypass line 746. The second filter line 741 includes the second ozone injector 728 and the second particulate filter with an oxidation catalyst coating 735. The second filter line 741 and the second bypass line 746 converge together to flow the treated exhaust emissions through the tailpipe 725.

FIGS. 2-7 show different examples of how an oxidation catalyst may be incorporated into a multi-particulate filter assembly. In some embodiments, a multi-particulate filter assembly may have an oxidation catalyst incorporated using more than one of the different techniques shown in FIGS. 2-7. For example, a multi-particulate filter assembly may include one or more particulate filters having an oxidation catalyst coating and may include one or more separate oxidation catalyst unit(s) provided downstream from one or more particulate filters.

Figure 8:
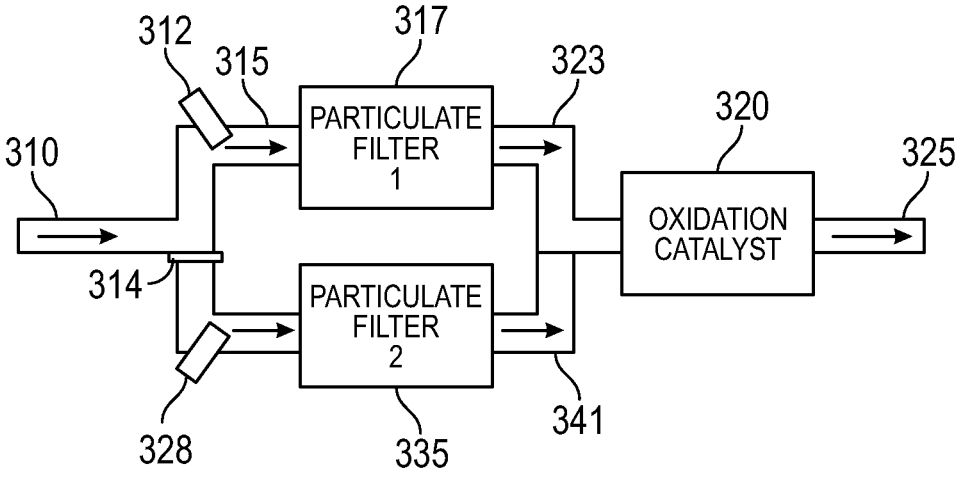
FIG. 8 is a process flow diagram of a double particulate filter assembly including two parallel particulate filters and a catalyst unit in accordance with one or more embodiments.
Figure 9:
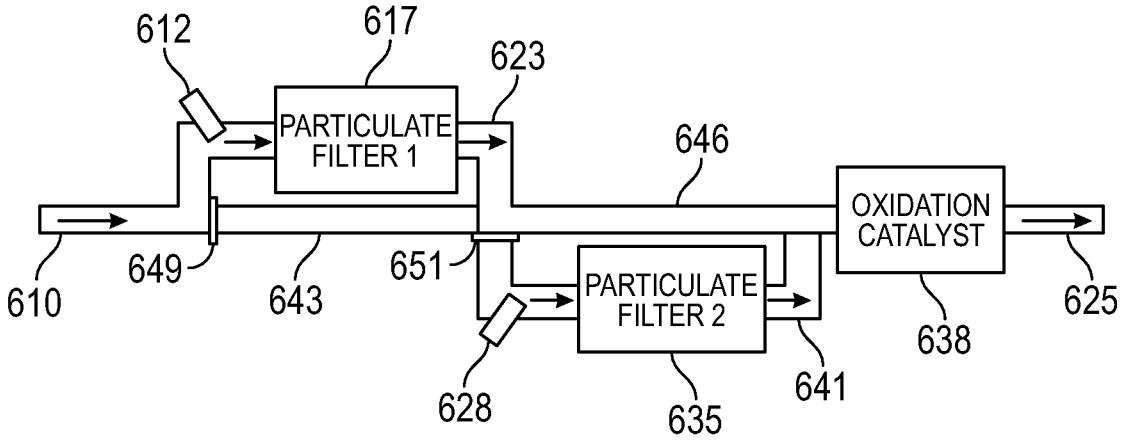
FIG. 9 shows a flow path through a process flow diagram of a double particulate filter assembly including two particulate filters each in series with a catalyst unit in accordance with one or more embodiments.
Figure 10:
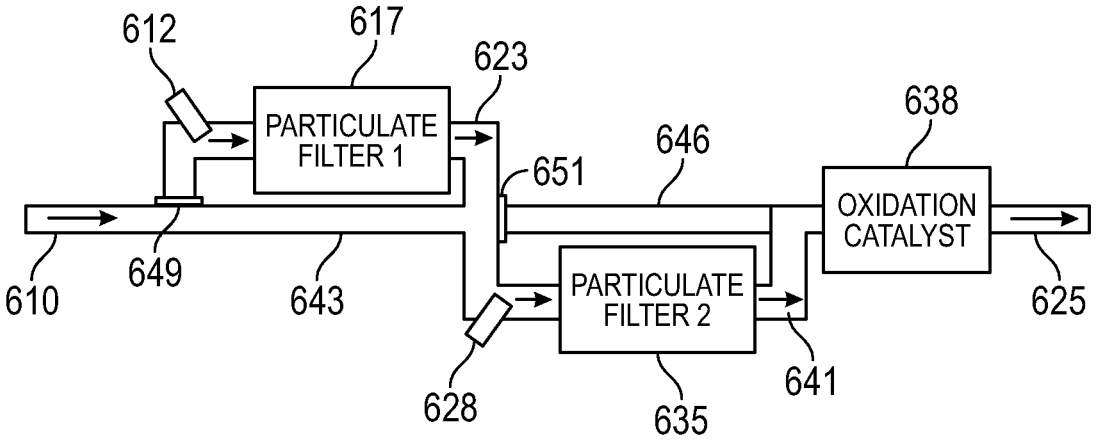
FIG. 10 shows a flow path through a process flow diagram of a double particulate filter assembly including two particulate filters in series with a catalyst unit in accordance with one or more embodiments.

Various example valve configurations are illustrated in FIGS. 8-10, demonstrating how valve(s) may be maneuvered to allow exhaust flow and filtering through one or more particulate filters (operating) while preventing exhaust flow through one or more other particulate filter(s) s (non-operating) to allow regeneration in the non-operating particulate filter(s) for various system configurations. The system configuration of FIG. 8 is the same as FIG. 3. In FIG. 8, the valve 314 is positioned to allow exhaust emissions to flow through the first filter line 323 through the first particulate filter 317 and through the single oxidation catalyst unit 320, while closing flow through the second filter line 341. In this arrangement, the second particulate filter 335 may be injected with ozone through the ozone injector 328 and regenerated, while filtering the exhaust emissions through the first particulate filter 317.

The system configuration of FIG. 9 is the same as FIG. 6. In FIG. 9, the first valve 649 is positioned to allow exhaust emissions to flow through the first filter line 623 and through the first particulate filter 617. The second valve 651 is positioned to flow the exhaust emissions through the second bypass line 646 and to the oxidation catalyst 638, while closing flow through the second filter line 641. During filtering the exhaust emissions through the first particulate filter 617, the second ozone injector 628 may inject ozone into the second filter line 641 upstream from and to the second particulate filter 635 to be used in regeneration of the second particulate filter 635.

The system configuration of FIG. 10 is the same as FIG. 6. In FIG. 10, the first valve 649 is switched from the first position shown in FIG. 9 to a second position to allow exhaust emissions to flow through the first bypass line 643, while closing flow to the first filter line 623. The second valve 651 is switched from the first position shown in FIG. 9 to a second position to allow exhaust emissions to flow through the second filter line 641, through the second particulate filter 635, and through the oxidation catalyst unit 638, while closing flow to the second bypass line 646. This configuration allows for the first ozone injector 612 to inject ozone into the first filter line 623 to be used in regeneration of the first particulate filter 617, while filtering the exhaust emissions through the second particulate filter 635.

Figure 11:
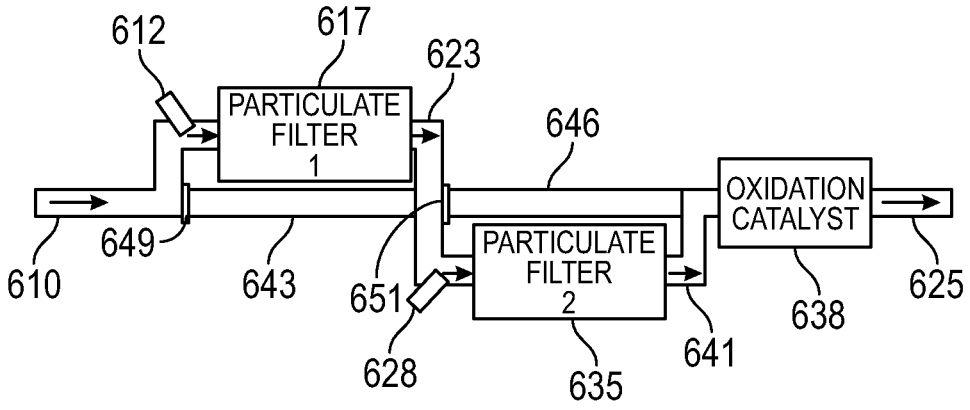
FIG. 11 is a process flow diagram of a double particulate filter assembly including two particulate filters in series with a catalyst unit in accordance with one or more embodiments.

The system configuration of FIG. 11 is the same as FIG. 6. FIG. 11 demonstrates both particulate filters 617, 635 being used in series. In FIG. 11, the first valve 649 is in the first position shown in FIG. 9 to allow exhaust emissions to flow through the first filter line 623 containing the first particulate filter 617. The second valve 651 is in the second position shown in FIG. 10 to allow the exhaust emissions to flow through the second filter line 641 containing the second particulate filter 635. The exhaust emissions flow from the second filter line 641 to the oxidation catalyst unit 638 and through the tailpipe 625. This configuration allows the exhaust emissions to be treated by both particulate filters in series.

In addition to the benefits of alternating between operating filtering and non-operating regenerating particulate filters, embodiments of the present disclosure may allow for a multi-particulate filter assembly to be positioned in an engine's exhaust system proximate to the exhaust system's outlet to the ambient environment. For example, in one or more embodiments, a multi-particulate filter assembly may be connected directly to a tailpipe of an exhaust system, where the tailpipe is the short segment of pipe forming the exhaust system's outlet to the ambient environment. In such embodiments, the multi-particulate filter assembly may replace the muffler in an engine exhaust system.

Figure 12A:
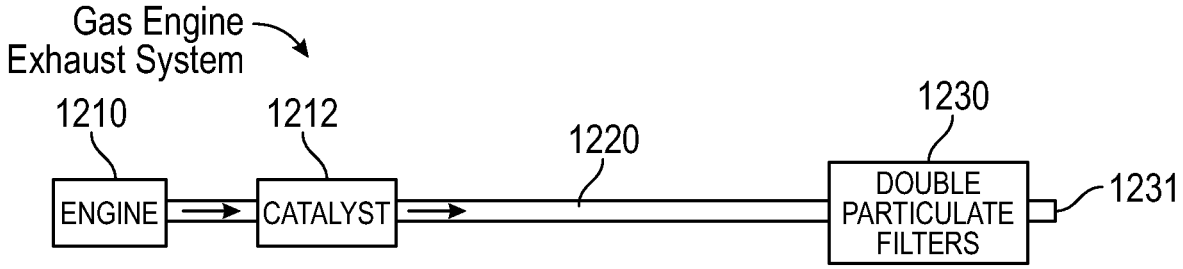
FIG. 12A-B are high level process flow diagrams of the overall system in gas engines in accordance with one or more embodiments.
Figure 12B:
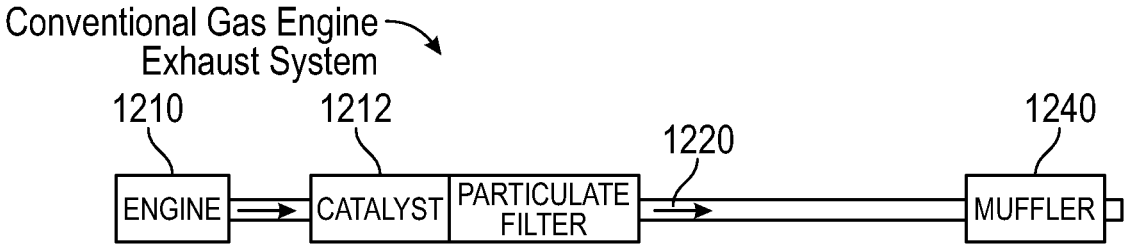

As shown in FIG. 12A, a double particulate filter assembly 1230 is located downstream of an engine 1210 along a main exhaust line 1220 at the end of the exhaust emission system. The double particulate filter assembly 1230 is connected between an end of the main exhaust line 1220 and a tailpipe, where the tailpipe forms the outlet 1231 of the exhaust system to the ambient environment. In the configuration shown in FIG. 12A, the exhaust system does not have a muffler. This contrasts a conventional engine exhaust system, as shown in FIG. 12B, where a muffler 1240 is located between the end of the main exhaust line and the tailpipe, and a particulate filter is located proximate the engine 1210. In both the system in 12A and 12B, a main catalyst 1212 is located downstream of the engine 1210 and upstream from a filtering system to convert high concentrations of pollutants exiting the engine.

Figure 13A:
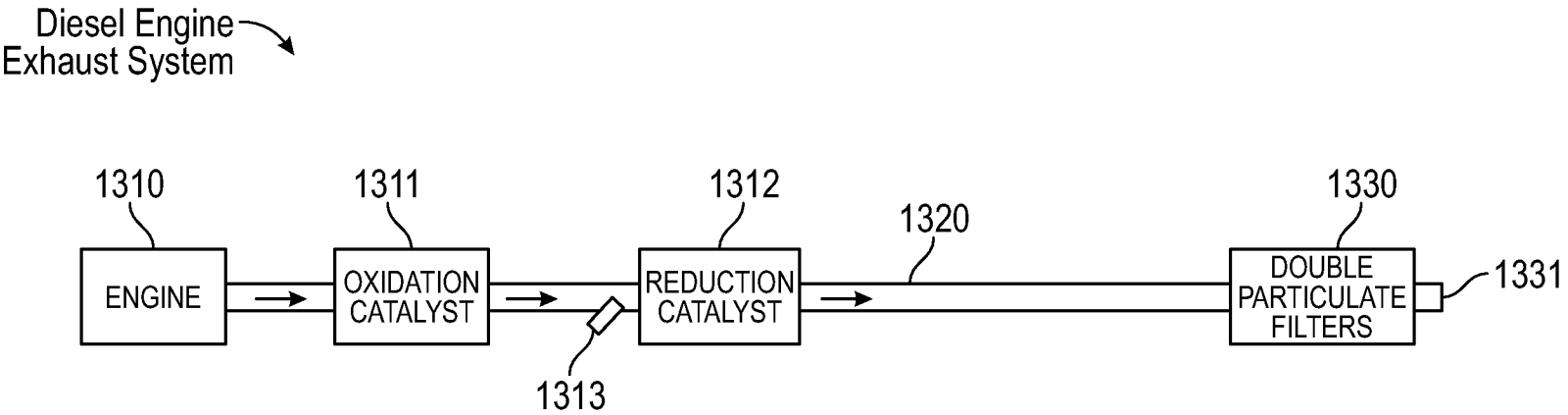
FIG. 13A-B are high level process flow diagrams of the overall system in diesel engines in accordance with one or more embodiments.
Figure 13B:
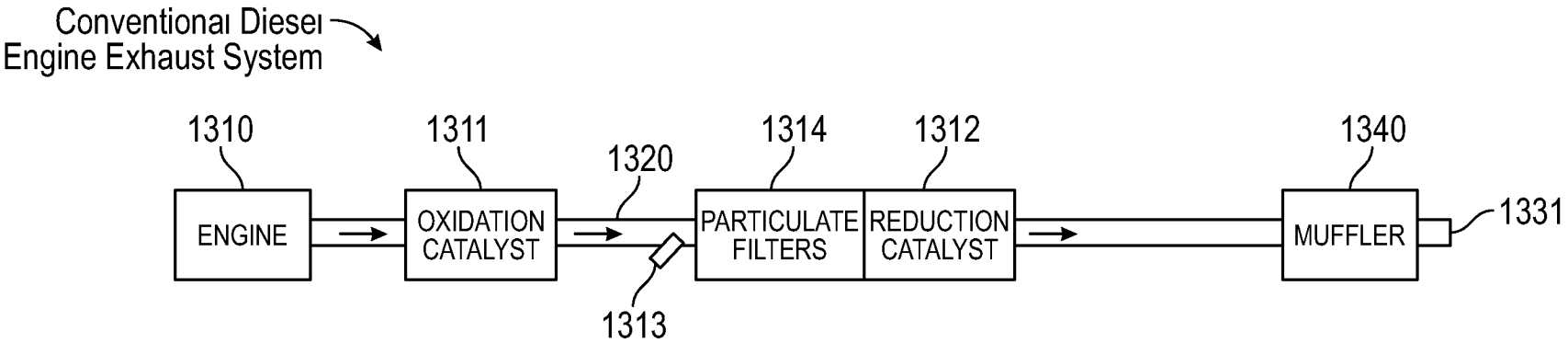

FIGS. 13A and 13B show additional examples of an exhaust system in accordance with embodiments of the present disclosure compared with an exhaust system utilizing conventional principles of emission reduction. In FIGS. 13A and 13B, the exhaust systems for a Diesel engine 1310 include a main exhaust line 1320 for directing exhaust out of the Diesel engine 1310, a main oxidation catalyst 1311 located in an upstream location along the main exhaust line 1320, a main reduction catalyst 1312 located downstream from the main oxidation catalyst 1311, and a Diesel exhaust fluid (DEF) injector 1313 located between the main oxidation catalyst 1311 and the main reduction catalyst 1312, where the DEF injector 1313 may inject a solution of aqueous urea (e.g., AdBlue®) upstream of the main reduction catalyst 1312. In the exhaust system shown in FIG. 13A, a double particulate filter 1330 is located downstream of the engine 1310, the main oxidation catalyst 1311, and the main reduction catalyst 1312, at the end of the exhaust line 1320, near the tailpipe (forming exhaust system outlet 1331). The double particulate filter 1330 may be an assembly of multiple particulate filters according to embodiments described herein (e.g., including first and second particulate filters assembled in parallel or in series, valve(s), an oxidation catalyst (separate from the main oxidation and reduction catalysts 1311, 1312), and ozone injector(s)). In contrast, the Diesel engine exhaust system shown in FIG. 13B includes a single particulate filter 1314 located upstream of the main reduction catalyst 1312 (between the main oxidation catalyst 1311 and the main reduction catalyst 1312), where a muffler 1340 is located in the region near the tailpipe.

According to embodiments of the present disclosure, a multi-particulate filter assembly may be located between 2 and 5 meters away from the engine 1310. The position of the multi-particulate filter assembly may be optimized based on the temperature of the engine, where the multi-particulate filter assembly may be in a location along a main exhaust line having exhaust with temperatures ranging from 100 to 300° C., e.g., for optimal ozone regeneration.

Multi-particulate filter assemblies may be used in exhaust systems of different types of engines having different configurations. For example, a multi-particulate filter assembly according to embodiments of the present disclosure may be used for various engines including those that utilize gasoline, Diesel, natural gas, and electrofuels.

EXAMPLE

Figure 14:
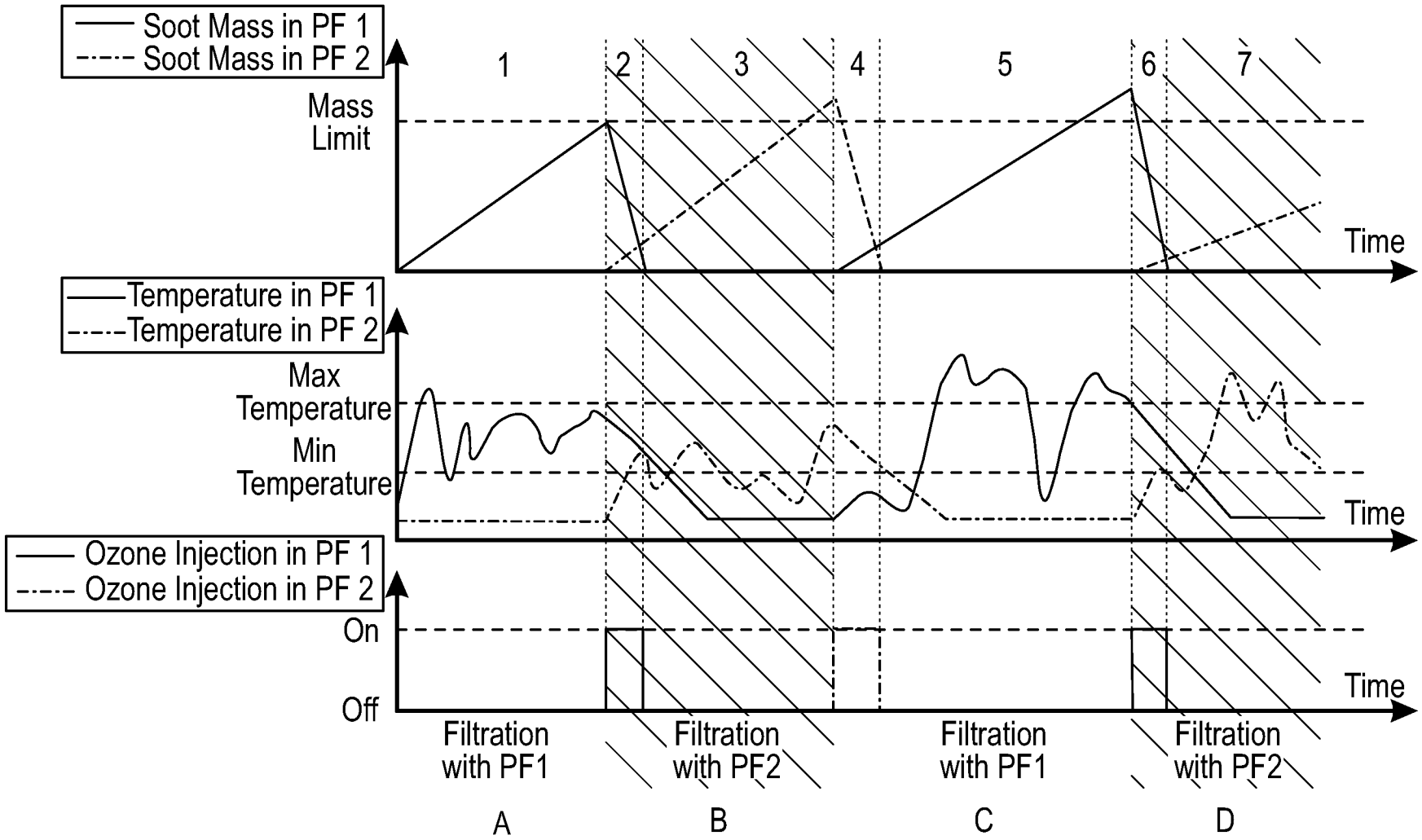
FIG. 14 is a graph of ozone injection, temperature, and soot mass in each particulate filter over time in accordance with one or more embodiments.

FIG. 14 shows expected trends for soot mass, temperature, and ozone injection in each particulate filter, PF1 and PF2, in a double particulate filter assembly according to embodiments of the present disclosure during an operational timeframe. The timeframe is broken up into 4 different time periods: A, B, C, and D. Each time period correlates to an operating particulate filter being used to filter exhaust while the other, non-operating particulate filter is being regenerated. Time period A is when filtration occurs with the first particulate filter, PF1. Time period B is when filtration occurs with the second particulate filter, PF2. Within time period B, regeneration of PF1 occurs alongside the filtering operation of PF2. Time period C is when filtration returns to the PF1. Within time period C, regeneration of PF2 occurs while PF1 is in operation to filter exhaust. During time period D, PF2 is operated to filter exhaust, and PF1 is regenerated while PF2 is in filtering operation.

As seen in FIG. 14, for demonstration purposes, the soot mass increases during the filtering operation for each particulate filter, typically to a mass limit between 5 and 20 g. Although a linear increase is shown in FIG. 14, actual processes may have soot mass increasing at a non-linear rate according to the engine operating points. When the regeneration stage begins for each of the particulate filters, the soot mass decreases drastically. Although a linear decrease is shown in FIG. 14, actual processes may have soot mass decreasing at a relatively faster rate at the beginning of the regeneration process due to links between the combustion rate and the soot loading and the temperature. The decrease in soot mass in a regenerating particulate filter overlaps in time with the increase in soot mass for the filtering operating particulate filter due to the simultaneous regenerating and filtering in a single time period.

The particulate filter temperature is less consistent over time than the changes in soot mass. The temperature oscillates for a particulate filter during filtering and regeneration, including temperature declines during and following the regeneration process, and temperature inclines and oscillations during filtering operations. In FIG. 14, the temperature oscillates between a minimum and maximum temperature limit. In some embodiments, the minimum temperature is between 100 to 200° C. for regeneration. In some embodiments, the maximum temperature is between 25° and 350° C. While the temperature during filtering with a particulate filter may not limited, the temperature for regenerating a particulate filter may be limited at the beginning of the regeneration to ensure temperatures are high enough for soot combustion but low enough to avoid thermal decomposition of ozone (e.g., a regeneration process may be initiated at temperatures ranging between 300-350° C. and continued in temperatures ranging between 100-300° C.). The temperature may be measured using temperature sensors at the inlet of the double particulate filter assembly and/or other locations along the double particulate filter assembly.

Ozone injection is shown to pulse to the on position at the beginning of the regeneration cycles only for the particulate filter undergoing regeneration. For example, at the beginning of the regeneration cycle for PF1 in time period B, ozone is injected from an associated ozone injector only to PF1, while no ozone is injected to PF2.

Embodiments of the present disclosure may provide at least one of the following advantages. The system configurations allow for continuous operation of a particulate filter while regenerating a separate non-operating particulate filter, improving efficiency of the system. By either coupling an oxidation catalyst with the particulate filter (e.g., as a coating) or situating the oxidation catalyst downstream of the particulate filter, this allows for the oxidation catalyst to convert carbon monoxide resulting from soot combustion of the particulate filter regeneration process before exiting the system into the environment.

Additionally, systems disclosed herein may provide a reduction in particulate filter back pressure by placing the particulate filter assembly near the tailpipe because the volumetric flow rate of exhaust through the exhaust system is lower at the tailpipe compared with the rest of the exhaust system. Thus, the exhaust system outlet position of double particulate filter assemblies according to embodiments of the present disclosure may in turn provide a reduction in engine power loss and a reduction in over-consumption of fuel. Also, by using double particulate filter systems in the disclosed exhaust system outlet positions, a double particulate filter assembly may replace a muffler, such that the engine exhaust system does not have a muffler, which may present an opportunity for cost savings.

Further, using ozone in double particulate filter assemblies according to embodiments of the present disclosure ensures soot combustion occurs at a lower temperature (between 100 to 300° C.) than when in the presence of oxygen (>600° C.), thereby negating the need for additional heat added to the system as typically occurs with oxygen-based soot combustion.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A system for reducing internal combustion engine emissions, comprising:

a main exhaust line fluidly connected to an internal combustion engine;

a multi-particulate filter assembly connected between the exhaust line and a tailpipe, the multi-particulate filter assembly comprising:

a first particulate filter positioned along a first filter line;

a second particulate filter positioned along a second filter line;

a first ozone injector positioned upstream of the first particulate filter along the first filter line;

a second ozone injector positioned upstream of the second particulate filter along the second filter line; and an oxidation catalyst;

wherein the first particulate filter and the second particulate filter are configured in a series arrangement, and a valve connected between the exhaust line and the multi-particulate filter assembly, wherein when the valve is in a first position, the exhaust line is in fluid communication with the first filter line, and wherein when the valve is in a second position, flow between the exhaust line and the first filter line is bypassed.

2. The system of claim 1, further comprising a second valve within the multi-particulate filter assembly wherein when the second valve is in a first position, the exhaust line is in fluid communication with the second filter line, and wherein when the second valve is in a second position, flow between the exhaust line and the second filter line is bypassed.

3. The system of claim 1, wherein an ozone generator supplies the first ozone injector and the second ozone injector with ozone.

4. The system of claim 1, further comprising a plurality of temperature sensors at an inlet to the multi-particulate filter assembly.

5. The system of claim 1, further comprising a plurality of pressure sensors situated at an inlet to the multi-particulate filter assembly.

6. The system of claim 1, further comprising a plurality of pressure sensors situated at an outlet to the multi-particulate filter assembly.

7. The system of claim 1, wherein the first particulate filter and the second particulate filter are made of materials selected from the group consisting of cordierite, silicon carbide, or combinations thereof.

8. The system of claim 1, wherein the oxidation catalyst comprises a platinum group metal selected from the group consisting of Platinum, Palladium, or a combination thereof.

9. The system of claim 1, wherein a loading of the oxidation catalyst is 25 $g/ft^3$ or less.

10. The system of claim 1, wherein the oxidation catalyst is a coating on an internal structure of the first particulate filter and the second particulate filter.

11. The system of claim 1, wherein the oxidation catalyst is provided in one or more catalyst units positioned downstream of at least one of the first particulate filter and the second particulate filter.

* * * * *